US006303020B1

(12) United States Patent
Podrebarac et al.

(10) Patent No.: US 6,303,020 B1
(45) Date of Patent: Oct. 16, 2001

(54) PROCESS FOR THE DESULFURIZATION OF PETROLEUM FEEDS

(75) Inventors: Gary G. Podrebarac; Gary R. Gildert; Willibrord A. Groten, all of Pasadena, TX (US)

(73) Assignee: Catalytic Distillation Technologies, Pasadena, TX (US)

( * ) Notice: Subject to any disclaimer, the term of this patent is extended or adjusted under 35 U.S.C. 154(b) by 0 days.

(21) Appl. No.: 09/502,509

(22) Filed: Feb. 11, 2000

Related U.S. Application Data

(60) Provisional application No. 60/175,147, filed on Jan. 7, 2000.

(51) Int. Cl.[7] ..... C10G 45/00; C10G 65/04

(52) U.S. Cl. ..... 208/210; 208/209; 208/213; 208/59

(58) Field of Search ..... 208/210, 209, 208/213, 59

(56) References Cited

U.S. PATENT DOCUMENTS

| | | | | |
|---|---|---|---|---|
| 2,061,845 | * | 11/1936 | Morrell | 208/210 |
| 3,349,027 | * | 10/1967 | Carr et al. | 208/210 |
| 3,519,557 | * | 7/1970 | Pruiss | 208/143 |
| 4,166,026 | * | 8/1979 | Fukui et al. | 208/210 |
| 4,173,528 | | 11/1979 | Frayer et al. . | |
| 4,194,964 | * | 3/1980 | Chen et al. | 208/108 |
| 4,243,519 | * | 1/1981 | Schorfheide | 208/210 |
| 4,392,945 | * | 7/1983 | Howard et al. | 208/210 |
| 4,430,203 | * | 2/1984 | Cash | 208/210 |
| 4,439,312 | * | 3/1984 | Asaoka et al. | 208/216 PP |
| 4,755,280 | * | 7/1988 | Hudson et al. | 208/89 |
| 4,801,373 | * | 1/1989 | Corman et al. | 208/210 |
| 5,110,444 | | 5/1992 | Haun et al. . | |
| 5,595,634 | * | 1/1997 | Hearn et al. | 203/209 |
| 5,597,476 | | 1/1997 | Hearn et al. . | |
| 5,705,052 | * | 1/1998 | Gupta | 208/57 |
| 5,720,872 | * | 2/1998 | Gupta | 208/57 |
| 5,837,130 | | 11/1998 | Crossland . | |
| 5,906,730 | * | 5/1999 | Hatanaka et al. | 208/210 |
| 6,036,844 | * | 3/2000 | Gupta et al. | 208/49 |
| 6,054,041 | * | 4/2000 | Ellis et al. | 208/210 |
| 6,083,378 | * | 7/2000 | Gildert et al. | 208/209 |
| 6,103,104 | * | 8/2000 | Gupta | 208/210 |

* cited by examiner

*Primary Examiner*—Nadine Preisch
(74) *Attorney, Agent, or Firm*—Kenneth H. Johnson

(57) ABSTRACT

A process for the hydrodesulfurization of a cracked naphtha stream is disclosed where very little of the valuable olefins are saturated. The process is a two staged process wherein the $H_2S$ is removed between the stages to prevent recombinant mercaptans formation. Because the $H_2S$ is removed between the stages milder conditions can be used in the second stage polishing reactor to achieve the same desulfurization levels with less olefin loss.

15 Claims, 2 Drawing Sheets

PROCESS FOR THE DESULFURIZATION OF PETROLEUM FEEDS

This application claims priority based on U.S. Ser. No. 60/175,147 filed Jan. 7, 2000.

BACKGROUND OF THE INVENTION

The present invention relates to a process for the desulfurization of a full boiling range fluid catalytic cracked naphtha by the reaction of hydrogen with the organic sulfur compounds present in a feed in the presence of a hydrodesulfurization catalysts. In particular the present invention may employ catalytic distillation steps which reduce sulfur to very low levels, makes more efficient use of hydrogen and causes less olefin hydrogenation for a full boiling range naphtha stream.

Petroleum distillate streams contain a variety of organic chemical components. Generally the streams are defined by their boiling range which determines the composition. The processing of the streams also affects the composition. For instance, products from either catalytic cracking or thermal cracking processes contain high concentrations of olefinic materials as well as saturated (alkanes) materials and polyunsaturated materials (diolefins). Additionally, these components may be any of the various isomers of the compounds.

The composition of untreated naphtha as it comes from the crude still, or straight run naphtha, is primarily influenced by the crude source. Naphthas from paraffinic crude sources have more saturated straight chain or cyclic compounds. As a general rule most of the "sweet" (low sulfur) crudes and naphthas are paraffinic. The naphthenic crudes contain more unsaturates and cyclic and polycyclic compounds. The higher sulfur content crudes tend to be naphthenic. Treatment of the different straight run naphthas may be slightly different depending upon their composition due to crude source.

Reformed naphtha or reformate generally requires no further treatment except perhaps distillation or solvent extraction for valuable aromatic product removal. Reformed naphthas have essentially no sulfur contaminants due to the severity of their pretreatment for the process and the process itself.

Cracked naphtha as it comes from the catalytic cracker has a relatively high octane number as a result of the olefinic and aromatic compounds contained therein. In some cases this fraction may contribute as much as half of the gasoline in the refinery pool together with a significant portion of the octane.

Catalytically cracked naphtha gasoline boiling range material currently forms a significant part (≈⅓) of the gasoline product pool in the United States and it provides the largest portion of the sulfur. The sulfur impurities may require removal, usually by hydrotreating, in order to comply with product specifications or to ensure compliance with environmental regulations. Some users wish the sulfur of the final product to be below 50 wppm.

The most common method of removal of the sulfur compounds is by hydrodesulfurization (HDS) in which the petroleum distillate is passed over a solid particulate catalyst comprising a hydrogenation metal supported on an alumina base. Additionally copious quantities of hydrogen are included in the feed. The following equations illustrate the reactions in a typical HDS unit:

$$RSH+H_2 \rightarrow RH+H_2S \quad (1)$$

$$RCl+H_2 \rightarrow RH+HCl \quad (2)$$

$$2RN+4H_2 \rightarrow RH+NH_3 \quad (3)$$

$$ROOH+2H_2 \rightarrow RH+H_2O \quad (4)$$

Typical operating conditions for the HDS reactions are:

| | |
|---|---|
| Temperature, ° F. | 600–780 |
| Pressure, psig | 600–3000 |
| $H_2$ recycle rate, SCF/bbl | 1500–3000 |
| Fresh $H_2$ makeup, SCF/bbl | 700–1000 |

After the hydrotreating is complete, the product may be fractionated or simply flashed to release the hydrogen sulfide and collect the now desulfurized naphtha. The loss of olefins by incidental hydrogenation is detrimental by the reduction of the octane rating of the naphtha and the reduction in the pool of olefins for other uses.

In addition to supplying high octane blending components the cracked naphthas are often used as sources of olefins in other processes such as etherifications. The conditions of hydrotreating of the naphtha fraction to remove sulfur will also saturate some of the olefinic compounds in the fraction reducing the octane and causing a loss of source olefins.

Various proposals have been made for removing sulfur while retaining the more desirable olefins. Since the olefins in the cracked naphtha are mainly in the low boiling fraction of these naphthas and the sulfur containing impurities tend to be concentrated in the high boiling fraction the most common solution has been prefractionation prior to hydrotreating. The prefractionation produces a light boiling range naphtha which boils in the range of $C_5$ to about 250° F. and a heavy boiling range naphtha which boils in the range of from about 250–475° F.

The predominant light or lower boiling sulfur compounds are mercaptans while the heavier or higher boiling compounds are thiophenes and other heterocyclic compounds. The separation by fractionation alone will not remove the mercaptans. However, in the past the mercaptans have been removed by oxidative processes involving caustic washing. A combination oxidative removal of the mercaptans followed by fractionation and hydrotreating of the heavier fraction is disclosed in U.S. Pat. No. 5,320,742. In the oxidative removal of the mercaptans the mercaptans are converted to the corresponding disulfides.

U.S. Pat. No. 5,597,476 discloses a two step process in which naphtha is fed to a first distillation column reactor which acts as a depentanizer or dehexanizer with the lighter material containing most of the olefins and mercaptans being boiled up into a first distillation reaction zone where the mercaptans are reacted with diolefins to form sulfides which are removed in the bottoms along with any higher boiling sulfur compounds. The bottoms are subjected to hydrodesulfurization in a second distillation column reactor where the sulfur compounds are converted to $H_2S$ and removed.

The use of two or more sequential catalyzed hydrodesulfurization treatments has been practiced for treating petroleum feeds to remove the organic sulfur compounds, however in these prior processes there is a significant quantity of "recombinant sulfur" in the product. Recombinant sulfur means new organic sulfur compounds, mainly mercaptans, that are formed by the reverse reaction of $H_2S$ from the preceding hydrodesulfurization or hydrodesulfurizations in succeeding hydrodesulfurizations with olefins in the feed. The $H_2S$ can recombine to form mercaptans thus increasing the amount of sulfur in the product. Also, the presence of $H_2S$ can cause more of the olefins to be saturated losing octane and consuming hydrogen.

The product from the sequential multibed hydrodesulfurizations does of course have lower sulfur content than a feed having less treatment, but each subsequent treatment has been less efficient than expected because of the recombinant sulfur.

In the present process the efficiency of a subsequent treatment has been increased by stripping the $H_2S$ from the treated feed prior to passing the feed to a subsequent hydrodesulfurization.

It is an advantage of the present invention that a full boiling range naphtha stream is hydrodesulfurized while the olefin content is maintained at a high percent of the original feed by sequential hydrodesulfurization with removal of $H_2S$ after each hydrodesulfurization. It is not believed that $H_2S$ has been removed between hydrodesulfurization treatments in sequential hydrodesulfurizations in the prior art, but rather the prior practice has been to remove the $H_2S$ after the final hydrodesulfurization.

SUMMARY OF THE INVENTION

In its broadest context the present invention is in a process of hydrodesulfurization of a petroleum feed containing organic sulfur compounds and preferably olefins by at least two sequential treatments of the feed by contact with hydrogen in the presence of a hydrodesulfurization catalyst to convert a portion of the organic sulfur compounds to $H_2S$, wherein the improvement is the removal of $H_2S$ from the feed after each said treatment.

In one embodiment of the present invention a full boiling range naphtha is subjected to a two stage process for the removal of organic sulfur by hydrodesulfurization. In the first stage the full boiling range naphtha is desulfurized in a distillation column reactor which acts as a splitter taking a hydrodesulfurized light naphtha overhead along with the $H_2S$ produced in the reactor. A significant portion of the $H_2S$ is removed from the overhead accumulator/separator. The heavier fraction is hydrodesulfurized and removed as a bottoms. The bottoms and overheads are then fed to an $H_2S$ stripper wherein the remainder of the $H_2S$ is stripped from the desulfurized naphtha. The bottoms from the $H_2S$ stripper are then fed to a second reactor (either a standard single pass reactor or a second distillation column reactor). The removal of the $H_2S$ serves two purposes. It prevents the formation of recombinant organic sulfur compounds and allows for less severe conditions for the same sulfur removal while preventing hydrogenation of olefins. Preferably, the organic sulfur content of the reduced stream is below 50 wppm.

As used herein the term "distillation column reactor" means a distillation column which also contains catalyst such that reaction and distillation are going on concurrently in the column. In a preferred embodiment the catalyst is prepared as a distillation structure and serves as both the catalyst and distillation structure.

DETAILED DESCRIPTION

Figure 1:
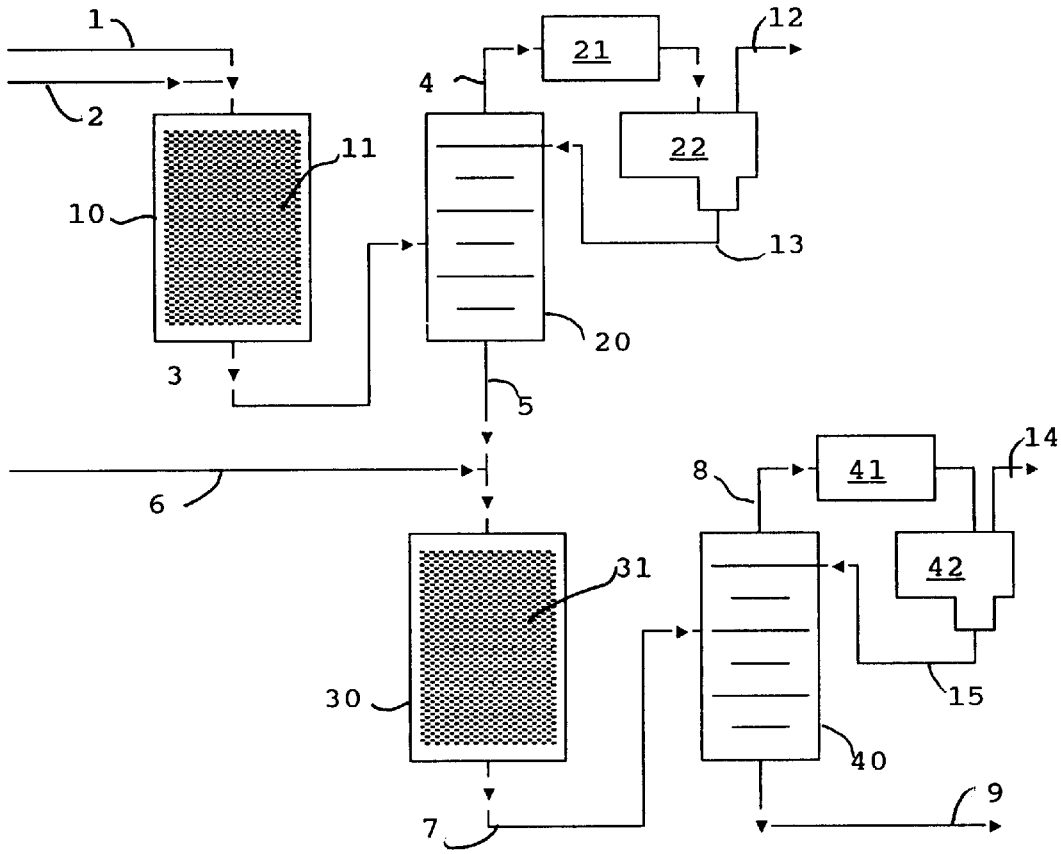
FIG. 1 is a flow diagram in schematic form using two straight pass hydrodesulfurization reactors in sequence and having $H_2S$ removal between the two reactors.

The feed to the process comprises a sulfur-containing petroleum fraction particularly from a fluidized bed catalytic cracking unit (FCCU) which boils in the gasoline boiling range ($C_5$ to 420° F.). Generally the process is useful on the naphtha boiling range material from catalytic cracker products because they contain the desired olefins and unwanted sulfur compounds. Straight run naphthas have very little olefinic material, and unless the crude source is "sour", very little sulfur.

The sulfur content of the catalytically cracked fractions will depend upon the sulfur content of the feed to the cracker as well as the boiling range of the selected fraction used as feed to the process. Lighter fractions will have lower sulfur contents than higher boiling fractions. The front end of the naphtha contains most of the high octane olefins but relatively little of the sulfur. The sulfur components in the front end are mainly mercaptans and typical of those compounds are: methyl mercaptan (b.p. 43° F.), ethyl mercaptan (b.p. 99° F.), n-propyl mercaptan (b.p. 154° F.), iso-propyl mercaptan (b.p. 135–140° F.), iso-butyl mercaptan (b.p. 190° F.), tert-butyl mercaptan (b.p. 147° F.), n-butyl mercaptan (b.p. 208° F.), sec-butyl mercaptan (b.p. 203° F.), iso-amyl mercaptan (b.p. 250° F.), n-amyl mercaptan (b.p. 259° F.), α-methylbutyl mercaptan (b.p. 234° F.), α-ethylpropyl mercaptan (b.p. 293° F.), n-hexyl mercaptan (b.p. 304° F.), 2-mercapto hexane (b.p. 284° F.), and 3-mercapto hexane (b.p. 135° F.). Typical sulfur compounds found in the heavier boiling fraction include the heavier mercaptans, thiophenes, sulfides and disulfides.

The reaction of organic sulfur compounds in a refinery stream with hydrogen over a catalyst to form $H_2S$ is typically called hydrodesulfurization. Hydrotreating is a broader term which includes saturation of olefins and aromatics and the reaction of organic nitrogen compounds to form ammonia. However hydrodesulfurization is included and is sometimes simply referred to as hydrotreating.

Catalysts which are useful for the hydrodesulfurization reaction include Group VIII metals such as cobalt, nickel, palladium, alone or in combination with other metals such as molybdenum or tungsten on a suitable support which may be alumina, silica-alumina, titania-zirconia or the like. Normally the metals are provided as the oxides of the metals supported on extrudates or spheres and as such are not generally useful as distillation structures.

The catalysts may additionally contain components from Group V and VIB metals of the Periodic Table or mixtures thereof. The Group VIII metal provides increased overall average activity. Catalysts containing a Group VIB metal such as molybdenum and a Group VIII such as cobalt or nickel are preferred. Catalysts suitable for the hydrodesulfurization reaction include cobalt-molybdenum, nickel-molybdenum and nickel-tungsten. The metals are generally present as oxides supported on a neutral base such as alumina, silica-alumina or the like. The metals are reduced to the sulfide either in use or prior to use by exposure to sulfur compound containing streams.

The properties of a typical hydrodesulfurization catalyst are shown in Table I below.

TABLE I

| | |
|---|---|
| Manufacture | Criterion Catalyst Co. |
| Designation | DC-130 |
| Form | Trilobe |

TABLE I-continued

| | |
|---|---|
| Nominal size | 1.3 mm diameter |
| Metal, Wt. % | |
| Cobalt | 3.4 |
| Molybdenum | 13.6 |
| Support | Alumina |

The catalyst typically is in the form of extrudates having a diameter of 1/8, 1/16 or 1/32 inches and an L/D of 1.5 to 10. The catalyst also may be in the form of spheres having the same diameters. In their regular form they form too compact a mass and are preferably prepared in the form of a catalytic distillation structure. The catalytic distillation structure must be able to function as catalyst and as mass transfer medium. Catalytic distillation structures useful for this purpose are disclosed in U.S. Pat. Nos. 4,731,229, 5,073,236, 5,431,890 and 5,266,546 which are incorporated by reference.

The use of the reaction distillation system (catalytic distillation) reduces the deactivation and provides for longer runs than the fixed bed hydrogenation units and is preferable for the first reactor. The distillation column reactor is advantageously used to react the heavier or higher boiling sulfur compounds. The overhead pressure is maintained at about 0 to 250 psig with the corresponding temperature in the distillation reaction zone of between 400 to 700° F. Hydrogen partial pressures of 0.1 to 70 psia may be used. In one preferred embodiment hydrogen partial pressure of 0.1 to 10 is used. Generally hydrogen partial pressures in the range of 0.5 to 50 psia give optimum results.

The second reactor can be a vapor phase single pass downflow reactor because the major portion of the sulfur compounds has been removed. Because the $H_2S$ and more difficult sulfur compounds have already been removed, the reactor can be operated at milder conditions, for instance at about 200 psig pressure, 500° F. reactor temperature and 3 liquid hourly space velocity.

If a second distillation column is used, a lower total pressure in the range of 25 to less than 300 psig is required for the hydrodesulfurization and hydrogen partial pressure of less than 150 psi, preferably down to 0.1 psi can be employed preferably about 15 to 50 psi. The temperature in the distillation reaction zone is in the range from 400 to 750° F. Hydrogen for the second distillation column reactor is fed in the range of one to ten standard cubic feet (SCF) per pound of feed. Nominal liquid hourly space velocities (liquid volume of feed per unit volume of catalyst) in the second column are in the range of 2–5. Typical conditions in a reaction distillation zone (second and subsequent columns) of a naphtha hydrodesulfurization distillation column reactor are:

| | |
|---|---|
| Temperature | 450–700° F. |
| Total Pressure | 75–300 psig |
| $H_2$ partial pressure | 6–75 psia |
| LHSV of naphtha | about 1–5 |
| $H_2$ rate | 10–1000 SCFB |

The operation of the distillation column reactor results in both a liquid and vapor phase within the distillation reaction zone. A considerable portion of the vapor is hydrogen while a portion is vaporous hydrocarbon from the petroleum fraction. Actual separation may only be a secondary consideration.

Without limiting the scope of the invention it is proposed that the mechanism that produces the effectiveness of the hydrogenation in the distillation column reactor is the condensation of a portion of the vapors in the reaction system, which occludes sufficient hydrogen in the condensed liquid to obtain the requisite intimate contact between the hydrogen and the sulfur compounds in the presence of the catalyst to result in their hydrogenation. In particular, sulfur species concentrate in the liquid while the olefins and $H_2S$ concentrate in the vapor allowing for high conversion of the sulfur compounds with low conversion of the olefin species.

The result of the operation of the process in the distillation column reactor is that lower hydrogen partial pressures (and thus lower total pressures) may be used. As in any distillation there is a temperature gradient within the distillation column reactor. The temperature at the lower end of the column contains higher boiling material and thus is at a higher temperature than the upper end of the column. The lower boiling fraction, which contains more easily removable sulfur compounds, is subjected to lower temperatures at the top of the column which provides for greater selectivity, that is, less hydrocracking or saturation of desirable olefinic compounds. The higher boiling portion is subjected to higher temperatures in the lower end of the distillation column reactor to crack open the sulfur containing ring compounds and hydrogenate the sulfur.

In between the two reactors is an $H_2S$ stripper which effectively removes all of the product $H_2S$ from the first column. This prevents contact of the $H_2S$ and olefins with the catalyst and the resultant formation of recombinant organic sulfur compounds and allows for less severe conditions in the second reactor for the same sulfur removal while preventing hydrogenation of olefins.

Referring now to FIG. 1 there is shown a schematic flow diagram of one embodiment of the invention. Naphtha is fed to a first single pass fixed bed reactor 10 via flow line 1 and hydrogen is fed to the reactor 10 via flow line 2. The reactor 10 contains a bed 11 of appropriate hydrodesulfurization catalyst. In the first reactor 10 a portion of the organic sulfur compounds reacts with hydrogen to form $H_2S$. The conditions in the first reactor are mild by hydrodesulfurization standards. For example the temperature is in the range of 550 to 600° F., the pressure is in the range 50 to 150 psig and the liquid hourly space velocity (LHSV) is in the range of 5 to 10 volumes of naphtha per volume of catalyst. The degree of desulfurization is thus somewhat less than normal, about 95%.

The effluent from the first reactor 10 is fed to a first stripping column 20 wherein the $H_2S$ and excess hydrogen are stripped out in the overheads via flow line 4. The condensible materials in the overheads are condensed in condenser 21 and separated from the $H_2S$ and hydrogen in separator 22. The excess hydrogen and $H_2S$ are removed via flow line 12. The condensed material is returned to the stripper as reflux via flow line 13.

The bottoms from the stripper 20 are fed to a second single pass fixed bed reactor 20 via flow line 5 with make up hydrogen being fed to the reactor 20 via flow line 2. The reactor 20 contains a second bed 21 of an appropriate hydrodesulfurization catalyst. The conditions in the second reactor are adjusted to give the desired degree of desulfurization. The effluent from the second reactor 20 is fed to a second stripper 40 where excess hydrogen and the $H_2S$ produced in the second reactor 20 is stripped out with the overheads via flow line 8. Again the condensible materials in the overheads are condensed in condenser 41 and separated from the hydrogen and $H_2S$ in separator 42 and returned to the second stripper via flow line 14 as reflux. The excess hydrogen and $H_2S$ are removed via flow line 14. The final product is removed as bottoms via flow line 9. Since the $H_2S$ is removed between the reactors milder conditions may be used in the second reactor and thus the olefins are not subject to hydrogenation conditions.

Figure 2:
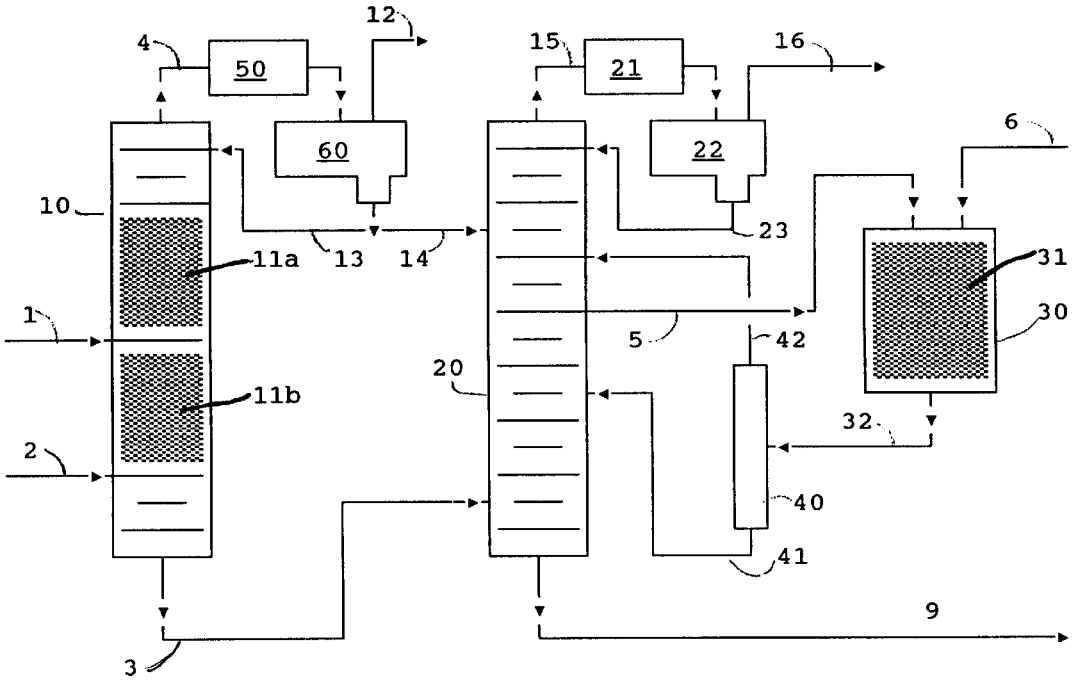
FIG. 2 is a flow diagram in schematic form using two hydrodesulfurization reactors in sequence, the first being a catalytic distillation reactor which has two hydrodesulfurization zones, one for a lighter fraction and one for the heavies, which are separately treated then combined in a stripper to remove $H_2S$ before going to a straight pass hydrodesulfurization unit.

Referring now to FIG. 2 there is shown a second embodiment of the invention wherein the first reactor is a distillation column reactor 10 containing two beds 11*a* and 11*b* of a hydrodesulfurization catalyst in the form of catalytic distillation structures. The naphtha is fed between the beds via flow line 1 and hydrogen is fed below the beds via flow line 2. Because the catalytic distillation column may be operated at lower pressures less of the olefins will be saturated. Also, the catalytic distillation column is more efficient at hydrogenating the heavy sulfur compounds such as the thiophenes and benzothiophenes. The catalytic distillation accomplishes a separation of a naphtha into a light boiling fraction boiling below about 250° F. and a heavy fraction boiling above about 250° F. A light naphtha is taken overheads via flow line 4 along with excess hydrogen and most of the $H_2S$ produced in the beds. The condensible material is condensed in condenser 50 and collected in separator 60 where the vapors, including the $H_2S$ and excess hydrogen, are removed via flow line 12. A portion of the condensed liquids is returned to the distillation column reactor 10 as reflux via flow line 13. The remainder of the liquid overheads is fed into the upper portion of a stripper column 20. The bottoms from the distillation column reactor 10 are also fed to the stripper column 20 but into the lower section via flow line 3.

The stripper column strips out the $H_2S$ in the overheads via flow line 15. The condensible materials in the overheads are condensed in condenser 21 and collected in separator 22 where it is separated from the excess hydrogen and $H_2S$. The excess hydrogen and $H_2S$ are removed from the separator via flow line 16 while the liquid is returned to the stripper as reflux via flow line 23. Final product is removed as bottoms via flow line 9.

A side stream is taken from the stripper 20 via flow line 5 and fed to a fixed bed single pass reactor 30 containing a bed 31 of a suitable hydrodesulfurization catalyst where the lighter organic sulfur compounds are reacted with hydrogen which is fed via flow line 6. Effluent from the reactor 20 is fed via flow line 32 to flash drum 40 where the hydrogen and $H_2S$ are flashed form the effluent and fed to the upper portion of the stripper 20 via flow line 42. The liquid from the flash drum is fed to the middle section of the stripper 20 via flow line 41 where any remaining $H_2S$ is stripped from the product.

EXAMPLE 1

A full boiling range cracked naphtha having the following characteristics was first treated in a catalytic distillation column containing 11,032 grams of a commercial Criterion DC-130 cobalt/molybdenum catalyst placed in the catalyst structures as disclosed in U.S. Pat. No. 5,730,843 disposed in a 3' nominal diameter in two sections of a 50 foot column with 15.1 feet of catalyst below the feed point and 18.7 feet of catalyst above the feed point. The hydrocarbon feed entered between the two catalyst beds.

| Feed Description | |
|---|---|
| Total sulfur | 2086 mg/liter |
| Total nitrogen | 64 mg/liter |
| Bromine No. | 52 |
| Density | 0.8005 g/cc @ 15.66° C. |
| ASTM D-2887 Distillation | |
| 5% | 160° F. |
| 10% | 174 |
| 20% | 205 |
| 30% | 231 |
| 40% | 258 |
| 50% | 283 |
| 60% | 320 |
| 70% | 338 |
| 80% | 382 |
| 90% | 419 |
| 95% | 442 |

The catalytic distillation column was run at 230 psig overhead pressure giving a catalyst bed temperature of 570° F. The catalytic distillation column running alone produced 96.7% sulfur removal with a 46.47% loss in bromine number (loss of olefins). Data from a commercial fixed bed single stage hydrotreater show that about 85% olefin (bromine #) would result at the same level of sulfur removal.

Only the overheads from the catalytic distillation column were stripped of $H_2S$ and excess hydrogen and then treated in a second stage conventional single pass fixed bed polishing reactor containing the same catalyst at the following conditions:

| | |
|---|---|
| WHSV | 8 |
| Hydrogen rate | 113.4 scf/bbl |
| Avg. temp | 470 F |
| Pressure | 200 psig. |

A combined desulfurization rate of 97.2% was obtained with only a 43.4% loss of olefins. As may be noted the second stage polishing reactor was operated at very mild conditions. This clearly shows the selectivity of the two stage process as operated according to the present invention compared to a single stage process.

EXAMPLE 2

The feed as described in Example 1 was processed in the distillation column reactor of Example 1. Only the overheads were stripped of $H_2S$ and excess hydrogen and processed at the following in the conditions in the polishing reactor to achieve a naphtha containing 27 wppm:

| | |
|---|---|
| WHSV | 8 |
| Hydrogen rate | 104 scf/bbl |
| Avg. temp | 510° F. |
| Pressure | 275 psig. |
| Combined Olefin Saturation | 51.5% |

Overall S conversion was 98.96%. The olefin saturation was 51.5%.

Data from a commercial single stage fixed bed unit show that a loss of about 92% of the olefins would be expected at the same desulfurization level.

EXAMPLE 3

A cracked naphtha having the following characteristics was treated in a catalytic distillation column of Example 1 containing commercial Criterion DC-130 cobalt/molybdenum catalyst as described.

| Feed Description | |
|---|---|
| Total sulfur | 1554 mg/liter |
| Total nitrogen | 132 mg/liter |
| Bromine No. | 30.5 |
| Density | 0.8288 g/cc @ 15.66° C. |
| ASTM D-2887 Distillation | |
| 5% | 195° F. |
| 10% | 229 |
| 20% | 265 |
| 30% | 288 |
| 40% | 322 |
| 50% | 336 |
| 60% | 362 |
| 70% | 384 |
| 80% | 399 |
| 90% | 412 |
| 95% | 428 |

The catalytic distillation column was run at 195 psig overhead pressure giving a catalyst bed temperature of 590° F. The catalytic distillation column running alone produced 98.98% sulfur removal with a 66.15% loss in olefins. However, the total sulfur content was about 24 wppm.

The combined overheads and bottoms were stripped of $H_2S$ and excess hydrogen and processed at the following conditions in the polishing reactor to achieve a naphtha containing only 7 wppm:

| | |
|---|---|
| WHSV | 12 |
| Hydrogen rate | 88 scf/bbl |
| Avg. temp | 510° F. |
| Pressure | 230 psig. |
| Combined Olefin Saturation | 67.4% at 99.7% sulfur conversion |

Data from a commercial fixed bed single stage hydrotreater show that about 95% olefin loss would result at the same level of sulfur removal.

What is claimed is:

1. A process for the hydrodesulfurization of a cracked naphtha stream comprising the steps of:

(a) feeding hydrogen and a naphtha stream containing organic sulfur compounds and olefins to a distillation column reactor containing a hydrodesulfurization catalyst;

(b) concurrently in said distillation column reactor;

(1) contacting said cracked naphtha and said hydrogen with said hydrodesulfurization catalyst at hydrodesulfurization conditions whereby a portion of said organic sulfur compounds react with said hydrogen to form $H_2S$, said conditions being such that said olefins remain unsaturated; and (2) separating said naphtha into a light fraction boiling below about 250° F. and a heavy fraction boiling above about 250° F.;

(c) removing said light fraction as overheads from said distillation column reactor along with $H_2S$ and unreacted hydrogen;

(d) removing said heavy fraction as bottoms from said distillation column reactor;

(e) combining said heavy fraction and said light fraction to form a first combined fraction and removing $H_2S$ therefrom;

(f) feeding a portion of the first combined fraction after $H_2S$ removal to a fixed bed single pass reaction zone containing a hydrodesulfurization catalyst wherein a portion of the remaining organic sulfur compounds are reacted with hydrogen to produce $H_2S$ and to produce a second combined fraction;

(g) removing $H_2S$ from said second combined fraction of step (f); and (h) recovering a product stream containing substantially less of organic sulfur compounds than said cracked naphtha stream.

2. The process of claim 1 wherein the second combined fraction of step (g) is combined with the first combined fraction and $H_2S$ is removed.

3. The process according to claim 1 wherein the organic sulfur content of the second $H_2S$ reduced stream is below 50 wppm.

4. The process according to claim 1 wherein said hydrodesulfurization catalyst comprises a Group VIII metal.

5. The process according to claim 4 wherein said hydrodesulfurization catalyst comprises a Group V metal.

6. The process according to claim 5 wherein said hydrodesulfurization catalyst comprises a Group VIB metal.

7. The process according to claim 4, 5 or 6 wherein said hydrodesulfurization catalyst comprises an oxide.

8. The process according to claim 4, 5 or 6 wherein said hydrodesulfurization catalyst comprises a sulfide.

9. A process for the hydrodesulfurization of a cracked naphtha stream comprising the steps of:

(a) feeding hydrogen and a naphtha stream containing organic sulfur compounds and olefins to a distillation column reactor containing a hydrodesulfurization catalyst;

(b) concurrently in said distillation column reactor;

(1) contacting said cracked naphtha and said hydrogen with said hydrodesulfurization catalyst at hydrodesulfurization conditions whereby a portion of said organic sulfur compounds react with said hydrogen to form $H_2S$; and (2) separating said naphtha into a light fraction boiling below about 250° F. and a heavy fraction boiling above about 250° F.;

(c) removing said light fraction as overheads from said distillation column reactor along with $H_2S$ and unreacted hydrogen;

(d) removing said heavy fraction as bottoms from said distillation column reactor;

(e) combining said heavy fraction and said light fraction to form a first combined fraction and removing $H_2S$ therefrom;

(f) feeding a portion of the first combined fraction after $H_2S$ removal to a fixed bed single pass reaction zone containing a hydrodesulfurization catalyst wherein a portion of the remaining organic sulfur compounds are reacted with hydrogen to produce $H_2S$ and to produce a second combined fraction;

(g) removing $H_2S$ from said second combined fraction of step (f); and (h) recovering a product stream containing substantially less of organic sulfur compounds than said cracked naphtha stream.

10. The process according to claim 9 wherein the organic sulfur content of the second $H_2S$ reduced stream is below 50 wppm.

11. The process according to claim 9 wherein said hydrodesulfurization catalyst comprises a Group VIII metal.

12. The process according to claim 11 wherein said hydrodesulfurization catalyst comprises a Group V metal.

13. The process according to claim 12 wherein said hydrodesulfurization catalyst comprises a Group VIB metal.

14. The process according to claim 11, 12 or 13 wherein said hydrodesulfurization catalyst comprises an oxide.

15. The process according to claim 11, 12 or 13 wherein said hydrodesulfurization catalyst comprises a sulfide.

* * * * *